US006431229B1

(12) United States Patent
Birtcher et al.

(10) Patent No.: US 6,431,229 B1
(45) Date of Patent: Aug. 13, 2002

(54) SOLVENTLESS PURGEABLE DIAPHRAGM VALVED MANIFOLD FOR LOW VAPOR PRESSURE CHEMICALS

(75) Inventors: Charles Michael Birtcher, Valley Center; Robert Sam Zorich, Carlsbad; Thomas Andrew Steidl, Escondido; Gil Vivanco, San Diego; Cynthia Lee Trent, Oceanside; David James Silva, San Diego, all of CA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/938,883

(22) Filed: Aug. 24, 2001

(51) Int. Cl.[7] ..... B65B 1/04

(52) U.S. Cl. ..... 141/302; 141/67; 141/100; 137/606

(58) Field of Search ..... 141/63, 67, 192, 141/198, 301, 302, 9, 100, 104; 137/606, 885, 863

(56) References Cited

U.S. PATENT DOCUMENTS 4,181,154 A * 1/1980 Oley et al. ..... 137/863
5,465,766 A 11/1995 Siegele et al. ..... 141/198
5,549,134 A * 8/1996 Browne et al. ..... 137/240
5,562,132 A 10/1996 Siegele et al. ..... 141/198
5,590,695 A 1/1997 Siegele et al. ..... 141/21
5,607,002 A 3/1997 Siegele et al. ..... 141/198
5,711,354 A 1/1998 Siegele et al. ..... 141/198
5,878,793 A 3/1999 Siegele et al. ..... 141/63
5,964,230 A 10/1999 Voloshin et al. ..... 134/98.1
5,964,254 A 10/1999 Jackson ..... 141/21
6,077,356 A 6/2000 Bouchard ..... 118/715
6,138,691 A 10/2000 Voloshin et al. ..... 134/22.11
6,161,875 A 12/2000 Yamaji et al. ..... 285/24

* cited by examiner

*Primary Examiner*—Steven O. Douglas
(74) *Attorney, Agent, or Firm*—Geoffrey L. Chase

(57) ABSTRACT

A manifold for transfer of chemical, comprising; a heated first conduit for connecting a vessel for containing the chemical to a another vessel, a source of pressurized gas and a source of vacuum; a heated first block valve assembly having first and second diaphragm valves, each valve having a diaphragm and a valve seat side and a diaphragm side, wherein the valve seat side of each valve is juxtaposed to the valve seat side of the other valve, and each valve seat side of each valve communicating with the first conduit; a first connector in the first conduit for detaching the conduit from the vessel; a second conduit, for delivering chemical to the vessel, the second conduit connected to the diaphragm side of the first valve; and a third conduit, for communicating pressurized gas and vacuum to the first conduit, connected to the diaphragm side of the second valve.

20 Claims, 2 Drawing Sheets

SOLVENTLESS PURGEABLE DIAPHRAGM VALVED MANIFOLD FOR LOW VAPOR PRESSURE CHEMICALS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to chemical delivery systems, and in particular to an apparatus for delivering high-purity or ultra-high purity chemicals to a use point, such as a semiconductor fabrication facility or tool(s) for chemical vapor deposition. Although the invention may have other applications, it is particularly applicable in semiconductor fabrication.

Semiconductor manufacturers require chemicals having at least a high-purity for production processes to avoid defects in the fabrication of semiconductor devices. The chemicals used in the fabrication of integrated circuits usually must have an ultra-high purity to allow satisfactory process yields. As integrated circuits have decreased in size, there has been an increase in the need to maintain the purity of source chemicals.

One ultra-high purity chemical used in the fabrication of integrated circuits is tetrakis(dimethylamido)titanium (TDMAT). TDMAT is used widely in integrated circuit manufacturing operations such as chemical vapor deposition (CVD) to form titanium and titanium nitride films, vias and barrier layers.

Integrated circuit fabricators typically require TDMAT with 99.99+% purity, preferably 99.999999+%(8–9's+%) purity. This high degree of purity is necessary to maintain satisfactory process yields. It also necessitates the use of special equipment to contain and deliver the high-purity or ultra-high purity TDMAT to CVD reaction chambers.

High-purity chemicals and ultra-high purity chemicals, such as TDMAT, are delivered from a bulk chemical delivery system to a use point, such as a semiconductor fabrication facility or tool(s). A delivery system for high-purity chemicals is disclosed in U.S. Pat. No. 5,465,766 (Seigele, et al.). (Related patents include U.S. Pat. Nos. 5,562,132; 5,590,695; 5,607,002; 5,711,354; 5,878,793 and 5,964,254.) The system comprises: a bulk canister located in a remote chemical cabinet with a delivery manifold/purge panel; a refillable stainless steel ampoule to supply high-purity source chemicals to an end user; and a control unit to supervise and control the refill operation and to monitor the level of the bulk container. The system has two basic modes of operation: (1) a normal process operation during which high-purity source chemical is supplied to the end user; and (2) the refill mode of operation during which the refillable stainless steel ampoule is refilled with high-purity chemical.

Solvent purging systems for removal of low vapor pressure chemicals from process conduits are disclosed in U.S. Pat. Nos. 5,964,230 and 6,138,691. Such systems add additional complexity to purging and increase the amount of materials which must be disposed of.

Low dead space couplings are known, such as U.S. Pat. No. 6,161,875.

TDMAT is considered a low vapor pressure, high purity chemical by the semiconductor industry, and thus presents special problems when breaking a process line or changing out a process container where the line must be cleaned prior to such detachment. Significant time delays in cleaning down a line or conduit are a disadvantage in the throughput of a wafer processing facility, where expensive tools and large batch processing of expensive wafers, each containing hundreds of integrated circuits require fast processing and avoidance of significant or lengthy offline time for cleaning or changeout of process containers or vessels.

The Present Invention is more specifically directed to the field of process chemical delivery in the electronics industry and other applications requiring low vapor pressure, high purity chemical delivery. More specifically, the present invention is directed to apparatus and processes for the cleaning of process chemical delivery lines, containers and associated apparatus, particularly during changeout of process chemical or process chemical containers in such process chemical delivery lines, quickly and thoroughly, but without the added complexity of solvent purge systems, when processing with low vapor pressure, high purity chemicals.

Evacuation and gas purge of process chemical lines has been used to remove residual chemicals from delivery lines. Both vacuum draw and inert gas purge are successful in quickly removing high volatility chemicals, but are not effective with low volatility chemicals. Safety is a problem when extracting highly toxic materials.

Use of solvents to remove residual chemicals has been suggested to remove low vapor pressure chemicals from process lines when the lines need to be disconnected such as for replacement of a vessel or container for either refill or maintenance. However, solvent systems are complex and require a source of solvent and a means to handle the contaminated solvent after it has been used for its cleaning function.

The present invention overcomes the drawbacks of the prior art in purging and cleaning chemical process lines for low vapor pressure chemicals without the requirements of lengthy purge cycles of pressurized gas and vacuum or the complexity of solvent systems, as will be more fully set forth below.

BRIEF SUMMARY OF THE INVENTION

The present invention is a purgeable manifold for transfer of low vapor pressure high purity chemicals in a high purity chemical delivery system, comprising; (a) a first conduit for detachably connecting a first vessel for containing the high purity chemical to a second vessel of high purity chemical, a source of pressurized gas and a source of vacuum; (b) a first block valve assembly having first and second diaphragm valves, each diaphragm valve having a diaphragm and having a valve seat side and a diaphragm side, wherein the valve seat side of each diaphragm valve is juxtaposed to the other valve seat side of the other diaphragm valve, and each valve seat side of each diaphragm valve having high purity chemical flow communication with the first conduit; (c) a first low dead space connector in the first conduit for detaching the conduit from the first vessel; (d) a second conduit, for delivering low vapor pressure, high purity chemicals to the first vessel, the second conduit connected to the diaphragm side of the first diaphragm valve; and (e) a third conduit, for communicating in a sequenced manner, pressurized gas and vacuum to the first conduit, connected to the diaphragm side of the second diaphragm valve.

More preferably, the present invention is a high purity chemical delivery system for refilling a vessel for low vapor pressure, high purity chemical and delivering the chemical to a process tool that uses the chemical, comprising: (a) a vessel for containing a low vapor pressure, high purity chemical; (b) a purgeable manifold for transfer of low vapor pressure high purity chemicals from a source of high purity chemical refill to the vessel, the manifold comprising; (i) a heated first conduit for detachably connecting the vessel to the source of high purity chemical refill, a source of pressurized gas and a source of vacuum; (ii) a heated first block valve assembly having first and second diaphragm valves, each diaphragm valve having a diaphragm and having a valve seat side and a diaphragm side, the diaphragm comprising a flexible disc having a convex side toward the diaphragm side of the valves and a concave side toward the valve seat side of the valve, wherein the valve seat side of each diaphragm valve is juxtaposed to the other valve seat side of the other diaphragm valve, and each valve seat side of each diaphragm valve, having high purity chemical flow communication with the first conduit, each diaphragm valve has a pneumatic valve actuator operatively engaged to the convex side of the diaphragm to actuate an open and closed condition of the diaphragm valves; (iii) a first low dead space connector in the first conduit for detaching the conduit from the vessel; (iv) a second conduit, for delivering low vapor pressure, high purity chemicals to the vessel, the second conduit connected to the diaphragm side of the first diaphragm valve; (v) a third conduit, for communicating in a sequenced manner, pressurized gas and vacuum to the first conduit, connected to the diaphragm side of the second diaphragm valve; (c) a source of pressurized gas; (d) a source of vacuum; and (e) a second block valve assembly having third and fourth diaphragm valves, each diaphragm valve having a diaphragm and having a valve seat side and a diaphragm side, wherein the valve seat side of each diaphragm valve is juxtaposed to the other valve seat side of the other diaphragm valve, each valve seat side of each diaphragm valve having flow communication with the third conduit, the third diaphragm valve connected to a source of pressurized gas through the diaphragm side of the third diaphragm valve, and the fourth diaphragm valve connected to a source of vacuum through the diaphragm side of the fourth diaphragm valve.

DETAILED DESCRIPTION OF THE INVENTION

Figure 1:
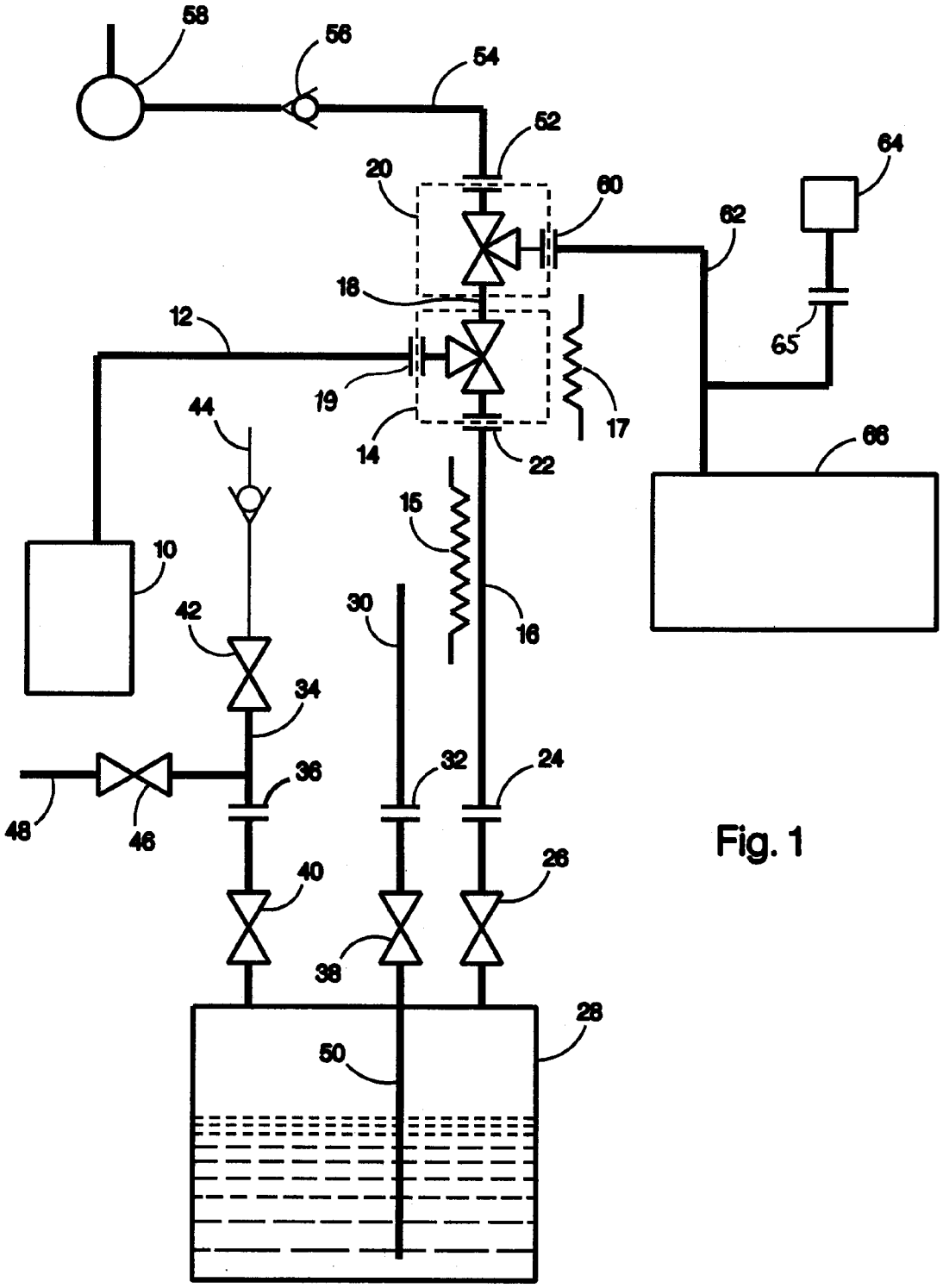
FIG. 1 is a schematic illustration of an embodiment of the present invention.

The present invention provides a readily cleanable and purgeable manifold for delivery of low vapor pressure, high purity chemical to a process vessel, which in turn dispenses the chemical to a process tool or reactor for consumption. The apparatus of the present invention is particularly suited for process chemicals used in the semiconductor industry.

Although the apparatus of the present invention is applicable to low vapor pressure chemicals, such as tetrakis (dimethylamido)titanium, it is also applicable to chemicals which do not have a low vapor pressure, i.e., high vapor pressure chemicals, and thus can be used with a wide array of chemicals.

The manifold and chemical delivery system of the present invention may be used in various applications with various fluids, but has particular application for liquid chemicals that have at least a high purity. For example, the liquid chemical may be selected from the group consisting of tetraethylorthosilicate (TEOS), borazine, aluminum trisec-butoxide, carbon tetrachloride, trichloroethanes, chloroform, trimethylphosphite, dichloroethylenes, trimethylborate, dichloromethane, titanium n-butoxide diethylsilane, hexafluoroacetylacetonato-copper(1)trimethylvinylsilane, isopropoxide, triethylphoshate, silicon tetrachloride, tantalum ethoxide, tetrakis(diethylamido)titanium (TDEAT), tetrakis(dimethylamido)titanium (TDMAT), bis-tertiarybutylamido silane, triethylborate, titanium tetrachloride, trimethylphosphate, trimethylorthosilicate, titanium ethoxide, tetramethyl-cyclo-tetrasiloxane, titanium n-propoxide, tris(trimethylsiloxy)boron, titanium isobutoxide, tris(trimethylsilyl)phosphate, 1,1,1,5,5,5-hexafluoro-2,4-pentanedione, tetramethylsilane and mixtures thereof.

The solventless purgeable manifold for a chemical delivery system of the present invention will now be described with regard to a particular embodiment processing TDMAT as the low vapor pressure, high purity chemical delivered from a bulk source of such TDMAT (source of high purity chemical refill) to the process vessel and then to a process tool of a semiconductor fab, wherein the TDMAT is supplied to the process vessel from the bulk source container as a liquid by pressurized gas delivery and then to the process tool as a vapor where the process vessel acts as a "bubbler".

In a bubbler, the liquid chemical is entrained in a pressurized gas or carrier gas that is bubbled into the liquid chemical, as it resides in the process vessel, through a diptube which introduces the pressurized gas into the liquid chemical below the surface of the chemical. The pressurized gas entrains or vaporizes some of the chemical and the vapor leaves with the pressurized gas through an outlet communicating with the process tool.

It is also possible to use the present invention in a liquid delivery to the process tool where the process vessel delivers liquid chemical out a diptube to the process tool by the action of pressurization gas on the headspace or liquid surface of the chemical in the process vessel (direct liquid injection or DLI).

Pressurizing gas can be any inert gas, such as nitrogen, helium or the rare gases.

With reference to FIG. 1, a high purity chemical delivery system is illustrated wherein a bulk source of TDMAT 10, i.e., source of high purity chemical refill, provides low vapor pressure, high purity chemical in liquid form through second conduit 12 by means of pressurized gas administered to the head space of the source 10. The TDMAT is delivered to the diaphragm side of a first diaphragm valve in a block valve assembly 14. The TDMAT is then passed through a conduit 16 of a manifold which connects to a process vessel 28 through first low dead space connection 24 and a manual valve 26. Conduit 16 can have a second low dead space connection 22 for further disassembly of the manifold. Conduit 16 is preferably heated using heat tracing or other heater elements, electric or heated fluids, 15 and appropriate insulation to maintain conduit 16 at a temperature to volatilize the low vapor pressure, high purity chemical. The block valve assembly 14 preferably also has a heating element or tracing 17 similar to what is described for conduit 16. Conduit 12 is equipped with connector 19.

The process vessel 28 is also outfitted with a source 30 of pressurized gas, such as nitrogen, that is connected through yet another, potentially low dead space, connection 32, manual valve 38 and diptube 50. The diptube 50 bubbles nitrogen through the chemical in vessel 28 to entrain or vaporize the chemical into the gas for delivery out of manual valve 40, potentially low dead space, connection 36, conduit 34 and valve 46 to the process tool destination 48, such as a titanium deposition reactor for a semiconductor integrated circuit product. Conduit 34 can be cleaned by venting through valve 42 to scrubber 44 by application of vacuum at the scrubber 44 and purge gas through conduit 30 in a repeated, cyclic manner until the conduit 34 is clean. This conduit 34 is not difficult to clean because it largely sees only vapor TDMAT and not liquid TDMAT (or other low vapor pressure, high purity chemical), in contrast to first conduit 16, which sees liquid chemical, such as TDMAT.

First conduit 16 is cleaned by sequenced, repeated application of pressurized gas, such as nitrogen, and vacuum to first conduit 16 through the first block valve assembly 14, third conduit 18, second block valve assembly 20, potentially low dead space connection 52, pressurized gas conduit 54, check valve 56 and nitrogen pressurized gas source 58. Vacuum is supplied through second block valve assembly 20, potentially low dead space connection 60, vacuum line 62 and vacuum pump source 66. Vacuum can be monitored by vacuum gauge 64 through connector 65.

Figure 2B:
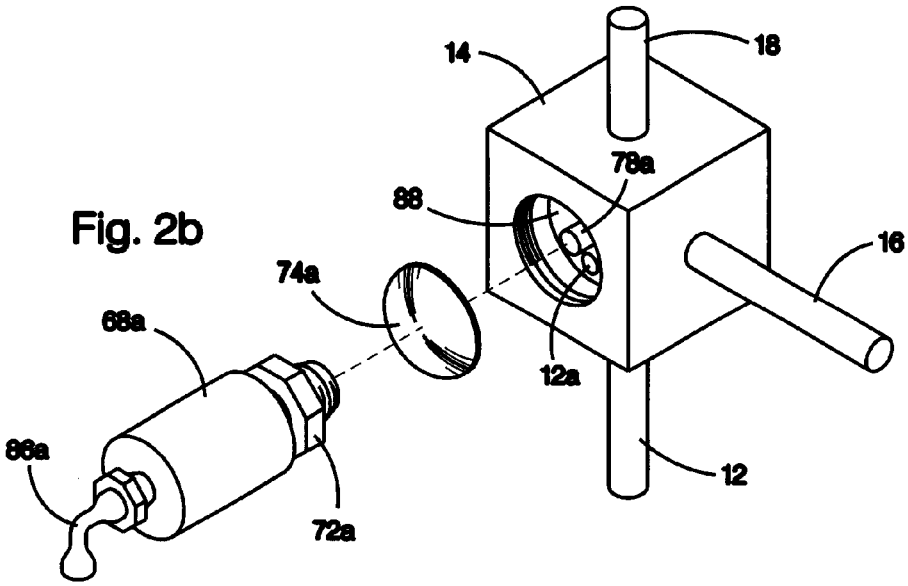
FIG. 2*b* is an exploded perspective view of the block valve of FIG. 2*a*.
Figure 2A:
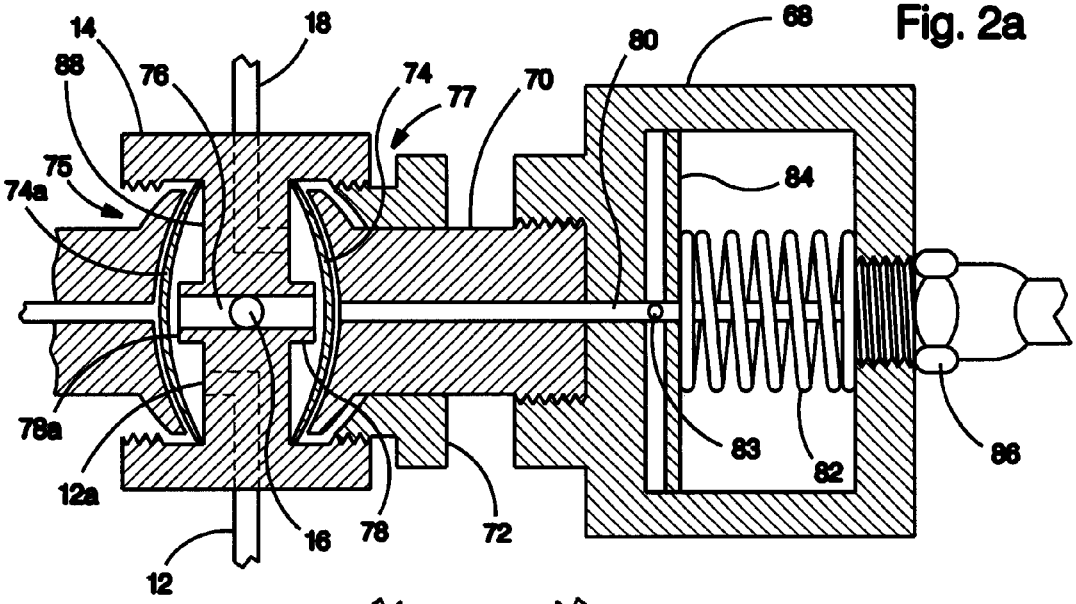
FIG. 2*a* is a cross-sectional view of block valve 14 of FIG. 1.

FIG. 2*a* shows greater detail of first block valve assembly 14, which is the same valve structure as second block valve assembly 20 (which is not shown separately in detail for that reason). FIG. 2*a* is a partial cross-section of first block valve assembly 14 showing liquid low vapor pressure, high purity chemical or second conduit 12 in flow communication with first diaphragm valve 75 comprising diaphragm 74*a* comprising a flexible metal disk with a convex side and a concave side comprising the valve seat side of the valve and valve seat 78*a*, as well as an actuator similar to that shown for valve 77. Conduit 12 communicates with valve 75 through aperture 12*a*. The diaphragm side of the diaphragm comprises the cross-sectional triangular area between the concave surface of the diaphragm 74*a*, the floor of core 88 and the surface of valve seat 78*a* in the closed condition. Valve seat 78*a* engages the concave side of the diaphragm 74*a* and allows liquid low vapor pressure, high purity TDMAT to pass through the valve when the diaphragm disengages the valve seat 78*a*, to the short channel 76 to conduit 16 which connects with the process vessel 28. Diaphragm 74*a* is actuated by any means, such as manual actuator, electric solenoid, hydraulic pressure actuation or preferably as illustrated, a pneumatic actuator, illustrated for the other diaphragm valve of block valve assembly 14.

Pressurizing gas and vacuum, are provided to first conduit 16 by way of conduit 18 and a second diaphragm valve 77 comprising diaphragm 74, valve seat 78, actuator connector 70, actuator armature 80, pneumatic actuator 68, bias spring 82, bellows or piston 84, which translates pneumatic pressure to valve actuation through armature 80 and pneumatic source 86. Pneumatic gas is supplied to bellows 84 by source 86 and a coaxial channel in armature 80 which communicates with bellows 84 through aperture 83. Pneumatic actuator is engaged to the diaphragm by locking nut 72. Second diaphragm valve 77 has a diaphragm side of its diaphragm 74 and a valve seat side, just as diaphragm valve 75. Valve 75 has a similar actuator structure as illustrated for valve 77.

The valve seat side of the diaphragm valves of the present invention have very little dead space or volume where a low vapor pressure liquid chemical can be retained. In addition, diaphragm valves 75 and 77 are juxtaposed to one another at the seat sides and connect to the conduit 16 via the very short channel 76 bored out of the monoblock of the block valve assembly 14 base. Due to this advantageous arrangement of these two valves, it is possible to clean first conduit 16 by application of sequenced pressurizing gas and vacuum, without the need for additional means, such as solvents. Cleanout can be accomplished in a short interval, such as several hours of sequenced pressurized gas and vacuum, in contrast to prior art systems which take several days to reach the prescribed level of residual chemical in the conduits prior to detachment of the conduits for maintenance or changeout of the vessel 28.

The valve seat side of the diaphragm valves comprises that portion of the valve in direct communication with the common conduit, such as 16, by way of the short channel, such as 76, and up to the sealing surface of the valve seat with the concave surface of the diaphragm when the valve is closed. The diaphragm side of the diaphragm valves comprises the other side of the sealing surface of the valve seat in communication with the aperture, such as 12a, and still under the concave side of the diaphragm. The diaphragm side of the diaphragm valve can be seen to constitute an annular, generally V-shaped cross-sectional space, as well as potentially areas on the convex side of the diaphragm, all of which can potentially become wetted with chemical and constitute a difficult area to effectively and quickly clean of such chemical. Therefore, the present invention, by having the common conduit or first conduit 16 communicate directly with the valve seat side of the diaphragm valves If the first block valve assembly and by having the diaphragm valves juxtaposed to one another through a very short connection or channel 76, affords a low dead space valve arrangement, which can be readily cleaned by application of sequenced, repeated pressurized gas and vacuum, without the use of solvent or use of extended purging.

The pneumatic actuator 68 has a source 86 of pressurized air for valve actuation. The valve 77 is a normally closed valve which is biased to the closed position by spring 82 operating on baffle 84 and actuator armature 80 which pushes against diaphragm 77 to engage the valve seat 78. Pressurized air passes through a coaxial tube through the center of spring 82 to an aperture 83 in the actuator armature 80, which is on the opposite side of baffle 84 from the spring 82. The air pressure acts against the baffle and spring to bias the diaphragm 77 open via the armature 80 and allow chemical to flow through the valve. This represents only one of several ways a pneumatic actuator operates and the operation of the pneumatic actuator is not an aspect of the present invention. Any of the known methods and apparatus for actuating using pneumatics can be contemplated, and in fact non-pneumatic actuation can be used, such as manual or solenoid actuation. Valve 75 is similarly equipped with valve actuation equipment, not illustrated, similar to 68, 70, 72 and 86.

FIG. 2*b* shows an exploded perspective view of the block valve assembly of FIG. 2*a*, this time showing the pneumatic actuator 68*a* for valve 75. The diaphragm valves' locations, illustrated for one valve as core 88, are bored out of a single monoblock of material, such as ceramics, plastics such as Teflon, or other suitable materials, but preferably is metal, such as electropolished stainless steel. Aperture 12*a* of second conduit 12 is illustrated to show the diaphragm side connection of the conduits in the valve. Valve seat 78*a* delineates the valve seat side of the sealing surface of the valve seat 78*a* and the diaphragm 74*a*, shown removed from its core location 88. Pneumatic actuator 68*a* is shown with its pneumatic gas source connection 86*a*. Chemical source or second conduit 12, pressurizing gas/vacuum source, or third conduit 18 and common or first conduit 16 to the process vessel 28 are shown respectively emanating from the monoblock of block valve assembly 14.

Second block valve assembly 20 is similar to first block valve assembly 14 as illustrated in FIG. 2*a*, with conduit 18 in this instance with regard to second block valve assembly 20 corresponding to the structure shown for first conduit 16, conduit 54 corresponding to the structure shown for second conduit 12, and conduit 62 corresponding to the structure shown for third conduit 18, as it relates to first block valve assembly.

Figure 3:
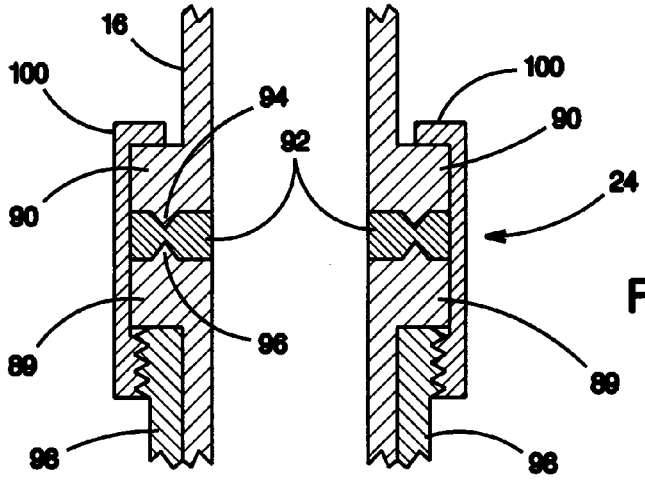
FIG. 3 is a cross-sectional view of the low dead space connection 24 of FIG. 1.

First low dead space connection 24 is illustrated in FIG. 3. Sealing surface 90 of first conduit 16 ends with an annular knife edge 94 depending axially from the sealing surface in the direction of the sealing surface 89 of the conduit comprising the inlet of valve 26, which also has an annular knife edge 96 depending axially from its sealing surface. These knife edges 94 and 96 engage an annular sealing gasket 92, which is preferably a relatively soft metal to form a low dead space connection with a superior seal. Compression fitting 100 threadably engages ring 98 to force the respective knife edges into sealing engagement with the annular soft metal gasket 92.

In operation, vessel 28 contains chemical, such as TDMAT. It is dispensed by pressurized gas, such as nitrogen, from conduit 30, bubbling through the liquid chemical in vessel 28. The TDMAT is entrained in the gas, which leaves the vessel through conduit 34 to process tool 48, where it is consumed.

To refill vessel 28, it is necessary for TDMAT from a bulk source of refill to be delivered into vessel 28 through second conduit 12, first block valve assembly 14 and first conduit 16. At times, it is necessary to clean first conduit 16 and first block valve assembly 14 periodically or for the purpose of maintenance, such as removal of vessel 28. Before first conduit 16 can be detached from the vessel 28, the first conduit must be very clean, or atmospheric reactions and corrosion can occur or operator exposure could occur with any residual chemical left in first conduit or the passageways associated with first conduit 16. Conduit 12 can have a connector 19 in accordance with FIG. 3.

For low vapor pressure chemicals, such as some of those listed above, i.e., TDMAT, such clean out of conduits conveying the liquid form of the chemical historically took days of purging and vacuum or required solvent purge. Using the apparatus of the present invention comprising a low dead space block valve assembly with diaphragm valves juxtaposed to one another in a single monoblock of material with the first conduit 16 connected to the valve seat side of the diaphragm valves for both chemical input 12 and gas/vacuum 18 assures that minimum space is required to be cleaned and minimal dead space exists where chemical could be retained. This significantly reduces the purge and vacuum times needed to effect appropriate levels of cleaning.

To clean conduit 16, diaphragm valve 75 is closed, diaphragm valve 77 is opened and the inside of conduit 16 is subject to repeated, sequential exposure to pressurized purge gas and vacuum from the cycling of second block vale assembly 20, to connect alternately gas through conduit 54 and vacuum through conduit 62 by the opening and closing of the two diaphragm valves of block valve assembly 20. Because there is very little dead space on the valve seat side of the diaphragm valves and the channel 76 between the juxtaposed diaphragm valves is very short due to its machining from a single monoblock of material, the conduit 16 is cleaned to the required extent in a matter of hours, rather than the days or solvent purging required prior to the present invention.

Although the first block valve assembly 14, conduit 16, heaters 15 and 17 and connectors 22 and 24 have been described with regard to refillable vessel 28, it is contemplated that a block valve assembly, heaters and connectors could be placed in conduit 12 to allow vessel 10 to be equipped in a similar manner to vessel 28, and therefore allow the conduit 12 to be quickly purged and cleaned without solvents or lengthy purge times when handling low vapor pressure, high purity chemicals.

The present invention has been set forth with regard to a preferred embodiment, but the full scope of the present invention should be ascertained from the claims below.

What is claimed is:

1. A purgeable manifold for transfer of low vapor pressure high purity chemicals in a high purity chemical delivery system, comprising:

(a) a first conduit for detachably connecting a first vessel, for containing the high purity chemical, to a second vessel of high purity chemical, a source of pressurized gas and a source of vacuum;

(b) a first block valve assembly having first and second diaphragm valves, each diaphragm valve having a diaphragm and having a valve seat side and a diaphragm side, wherein the valve seat side of each diaphragm valve is juxtaposed to the other valve seat side of the other diaphragm valve, and each valve seat side of each diaphragm valve having high purity chemical flow communication with said first conduit;

(c) a first low dead space connector in said first conduit for detaching said conduit from said first vessel;

(d) a second conduit, for delivering low vapor pressure, high purity chemicals to said first vessel from said source of high purity chemical refill, said second conduit connected to the diaphragm side of said first diaphragm valve; and (e) a third conduit, for communicating in a sequenced manner, pressurized gas and vacuum to said first conduit, connected to the diaphragm side of said second diaphragm valve.

2. The manifold of claim 1 wherein said diaphragms comprise a flexible disc having a convex side toward the diaphragm side of said valves and a concave side toward the valve seat side of said valve.

3. The manifold of claim 2 wherein each diaphragm valve has a valve actuator operatively engaged to the convex side of said diaphragm to actuate an open and closed condition of said diaphragm valves.

4. The manifold of claim 1 further comprising a heater for said first conduit and said first block valve assembly.

5. The manifold of claim 1 having a second block valve assembly having third and fourth diaphragm valves, each diaphragm valve having a diaphragm and having a valve seat side and a diaphragm side, wherein the valve seat side of each diaphragm valve is juxtaposed to the other valve seat side of the other diaphragm valve, each valve seat side of each diaphragm valve having flow communication with said third conduit, said third diaphragm valve connected to a source of pressurized gas through the diaphragm side of said third diaphragm valve, and said fourth diaphragm valve connected to a source of vacuum through the diaphragm side of said fourth diaphragm valve.

6. The manifold of claim 5 wherein each diaphragm valve has a valve actuator operatively engaged to the convex side of said diaphragm to actuate an open and closed condition of said diaphragm valves.

7. The manifold of claim 1 wherein said first low dead space connector comprises a first sealing surface on said first conduit, a second sealing surface on a conduit connected to said first vessel, an annular sealing gasket between said first and second sealing surfaces, wherein said first and second sealing surfaces have a knife edge depending axially from each surface engaging and deforming said annular sealing gasket, and a compression fitting for forceably engaging said first and second sealing surfaces and said annular sealing gasket.

8. A purgeable manifold for transfer of low vapor pressure high purity chemicals in a high purity chemical delivery system, comprising:

(a) a first conduit for detachably connecting a vessel for dispensing the high purity chemical to a source of high purity chemical refill, a source of pressurized gas and a source of vacuum;

(b) a first block valve assembly having first and second diaphragm valves, each diaphragm valve having a diaphragm and having a valve seat side and a diaphragm side, said diaphragm comprising a flexible disc having a convex side toward the diaphragm side of said valves and a concave side toward the valve seat side of said valve, wherein the valve seat side of each diaphragm valve is juxtaposed to the other valve seat side of the other diaphragm valve, and each valve seat side of each diaphragm valve having high purity chemical flow communication with said first conduit, each diaphragm valve has a pneumatic valve actuator operatively engaged to the convex side of said diaphragm to actuate an open and closed condition of said diaphragm valves;

(c) a first low dead space connector in said first conduit for detaching said conduit from said vessel;

(d) a second conduit, for delivering low vapor pressure, high purity chemicals to said vessel from said source of high purity chemical refill, said second conduit connected to the diaphragm side of said first diaphragm valve;

(e) a third conduit, for communicating in a sequenced manner, pressurized gas and vacuum to said first conduit, connected to the diaphragm side of said second diaphragm valve; and (f) a second block valve assembly having third and fourth diaphragm valves, each diaphragm valve having a diaphragm and having a valve seat side and a diaphragm side, wherein the valve seat side of each diaphragm valve is juxtaposed to the other valve seat side of the other diaphragm valve, each valve seat side of each diaphragm valve having flow communication with said third conduit, said third diaphragm valve connected to a source of pressurized gas through the diaphragm side of said third diaphragm valve, and said fourth diaphragm valve connected to a source of vacuum through the diaphragm side of said fourth diaphragm valve.

9. The manifold of claim 8 wherein said first conduit is connected to said vessel through a second low dead space connector and a fifth valve connected to said vessel.

10. The manifold of claim 9 wherein said vessel has an outlet to dispense said low vapor pressure, high purity chemical to a process tool that uses said chemical.

11. The manifold of claim 10 wherein said outlet has a valve to control the flow of said low vapor pressure, high purity chemical.

12. The manifold of claim 10 wherein said vessel has a diptube inlet to supply a second source of pressurized gas to said vessel.

13. The manifold of claim 12 wherein said inlet has a valve to control the flow of said pressurized gas.

14. A high purity chemical delivery system for refilling a vessel for low vapor pressure, high purity chemical and delivering said chemical to a process tool that uses said chemical, comprising:

(a) a vessel for containing a low vapor pressure, high purity chemical;

(b) a purgeable manifold for transfer of low vapor pressure high purity chemicals from a source of high purity chemical refill to said vessel, comprising; (i) a heated first conduit for detachably connecting said vessel to said source of high purity chemical refill, a source of pressurized gas and a source of vacuum; (ii) a heated first block valve assembly having first and second diaphragm valves, each diaphragm valve having a diaphragm and having a valve seat side and a diaphragm side, said diaphragm comprising a flexible disc having a convex side toward the diaphragm side of said valves and a concave side toward the valve seat side of said valve, wherein the valve seat side of each diaphragm valve is juxtaposed to the other valve seat side of the other diaphragm valve, and each valve seat side of each diaphragm valve having high purity chemical flow communication with said first conduit, each diaphragm valve has a pneumatic valve actuator operatively engaged to the convex side of said diaphragm to actuate an open and closed condition of said diaphragm valves; (iii) a first low dead space connector in said first conduit for detaching said conduit from said vessel; (iv) a second conduit, for delivering low vapor pressure, high purity chemicals to said vessel from said source of high purity chemical refill, said second conduit connected to the diaphragm side of said first diaphragm valve; (v) a third conduit, for communicating in a sequenced manner, pressurized gas and vacuum to said first conduit, connected to the diaphragm side of said second diaphragm valve;

(c) a source of pressurized gas; and (d) a source of vacuum.

15. A high purity chemical delivery system for refilling a vessel for low vapor pressure, high purity chemical and delivering said chemical to a process tool that uses said chemical, comprising:

(a) a vessel for containing a low vapor pressure, high purity chemical;

(b) a purgeable manifold for transfer of low vapor pressure high purity chemicals from a source of high purity chemical refill to said vessel, comprising; (i) a heated first conduit for detachably connecting said vessel to said source of high purity chemical refill, a source of pressurized gas and a source of vacuum; (ii) a heated first block valve assembly having first and second diaphragm valves, each diaphragm valve having a diaphragm and having a valve seat side and a diaphragm side, said diaphragm comprising a flexible disc having a convex side toward the diaphragm side of said valves and a concave side toward the valve seat side of said valve, wherein the valve seat side of each diaphragm valve is juxtaposed to the other valve seat side of the other diaphragm valve, and each valve seat side of each diaphragm valve having high purity chemical flow communication with said first conduit, each diaphragm valve has a pneumatic valve actuator operatively engaged to the convex side of said diaphragm to actuate an open and closed condition of said diaphragm valves; (iii) a first low dead space connector in said first conduit for detaching said conduit from said vessel; (iv) a second conduit, for delivering low vapor pressure, high purity chemicals to said vessel from said source of high purity chemical refill, said second conduit connected to the diaphragm side of said first diaphragm valve; (v) a third conduit, for communicating in a sequenced manner, pressurized gas and vacuum to said first conduit, connected to the diaphragm side of said second diaphragm valve;

(c) a source of pressurized gas;

(d) a source of vacuum;

(e) a second block valve assembly having third and fourth diaphragm valves, each diaphragm valve having a diaphragm and having a valve seat side and a diaphragm side, wherein the valve seat side of each diaphragm valve is juxtaposed to the other valve seat side of the other diaphragm valve, each valve seat side of each diaphragm valve having flow communication with said third conduit, said third diaphragm valve connected to a source of pressurized gas through the diaphragm side of said third diaphragm valve, and said fourth diaphragm valve connected to a source of vacuum through the diaphragm side of said fourth diaphragm valve.

16. The manifold of claim 15 wherein said first conduit is connected to said vessel through a second low dead space connector and a fifth valve connected to said vessel.

17. The manifold of claim 15 wherein said vessel has an outlet to dispense said low vapor pressure, high purity chemical to a process tool that uses said chemical.

18. The manifold of claim 15 wherein said outlet has a valve to control the flow of said low vapor pressure, high purity chemical.

19. The manifold of claim 15 wherein said vessel has a diptube inlet to supply a second source of pressurized gas to said vessel.

20. The manifold of claim 19 wherein said inlet has a valve to control the flow of said pressurized gas.

* * * * *